US005780192A

United States Patent [19]

O'Regan et al.

[11] Patent Number: 5,780,192

[45] Date of Patent: Jul. 14, 1998

[54] ELECTROPHOTOGRAPHIC ELEMENTS EXHIBITING REDUCED NUMBERS OF BLACK SPOTS IN DISCHARGE AREA DEVELOPMENT SYSTEMS

[75] Inventors: Marie B. O'Regan, Rochester; Anne F. Lairmore, Hilton; Jeffrey R. Murray, Palmyra; Louis J. Sorriero, Rochester; Albert V. Buettner, Rochester; David S. Weiss, Rochester, all of N.Y.

[73] Assignee: Eastman Kodak Company, Rochester, N.Y.

[21] Appl. No.: 800,247

[22] Filed: Feb. 13, 1997

[51] Int. Cl.[6] ..... G03G 5/05

[52] U.S. Cl. ..... 430/58; 430/96

[58] Field of Search ..... 430/58, 59, 96

[56] References Cited

U.S. PATENT DOCUMENTS

| | | | |
|---|---|---|---|
| 4,175,961 | 11/1979 | Wright et al. | 430/58 |
| 4,847,175 | 7/1989 | Pavlisko et al. | 430/58 |
| 5,071,723 | 12/1991 | Koyama et al. | 430/58 |
| 5,223,361 | 6/1993 | Mishra et al. | 430/58 |
| 5,320,922 | 6/1994 | Mayama et al. | 430/63 |
| 5,376,485 | 12/1994 | Yoshihara | 430/58 |
| 5,604,063 | 2/1997 | Endo et al. | 430/96 |

OTHER PUBLICATIONS

L. Sorriero, M. O'Regan, P. Borsenberger, Electrophotographic Elements Having Charge transport Layers Containing High Mobility Polyester Binders, U.S. application Ser. No. 08/584,502, filed Aug. 22, 1995.

*Primary Examiner*—John Goodrow
*Attorney, Agent, or Firm*—John R. Everett

[57] ABSTRACT

A multiactive photoconductive element exhibiting reduced black spots in discharged area development systems. The element includes (A) a conductive layer, (B) an aggregate charge generation layer in direct physcial contact with the conductive layer and (C) a charge transport layer. The charge generation layer contains (i) a binder an adhesive polymer. The charge transport layer contains a binder according to formula II:

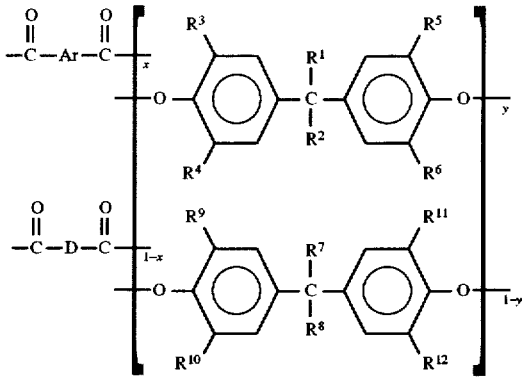

II wherein the

Ar, $R^1$, $R^2$, $R^7$, $R^8$, $R^3$, $R^4$, $R^5$, $R^6$, $R^9$, $R^{10}$, $R^{11}$, and $R^{12}$ and x are defined in the specification.

11 Claims, No Drawings

ELECTROPHOTOGRAPHIC ELEMENTS EXHIBITING REDUCED NUMBERS OF BLACK SPOTS IN DISCHARGE AREA DEVELOPMENT SYSTEMS

FIELD OF THE INVENTION

This invention relates to electrophotography, particularly in discharged area development systems.

BACKGROUND OF THE INVENTION

Electrophotographic imaging processes and techniques have been extensively described in both the patent and other literature, for example, U.S. Pat. Nos. 2,221,776; 2,227,013;,2,297,691; 2,357,809; 2,551,582; 2,825,814; 2,833,648; 3,220,324; 3,220,831; 3,220,833 and many others. Generally, these processes have in common the steps of employing a photoconductive insulating element which is prepared to respond to imagewise exposure with electromagnetic radiation by forming a latent electrostatic charge image. A variety of subsequent operations, now well-known in the art, can then be employed to produce a visible record of the electrostatic image.

A group of important electrophotographic elements used in these processes comprise a conductive support in electrical contact with a charge generation layer (CGL) and a charge transport layer (CTL). The concept of using two or more active layers in electrophotographic elements, at least one of the layers designed primarily for the photogeneration of charge carriers and at least one other layer designed primarily for the transportation of these generated charge carriers are sometimes referred to as multilayer or multiactive electrophotographic elements. Patent publications disclosing methods and material for making and using such elements include: Bardeen, U.S. Pat. No. 3,401,166 issued Jun. 26, 1962; Makino, U.S. Pat. No. 3,394,001 issued Jul. 23, 1968; Makino et. al. U.S. Pat. No. 3,679,405 issued Jul. 25, 1972; Hayaski et. al., U.S. Pat. No. 3,725,058 issued Apr. 3, 1973; Canadian Patent No. 930,591 issued Jul. 24, 1973; and Canadian Patent Nos. 932,197–199 issued Aug. 21, 1973; British Patent Nos. 1,337,228 and 1,343,671 and Berwick's U.S. Pat. No. 4,284,699. More recent publications include U.S. Pat. Nos. 4,701,396; 4,666,802; 4,427,139; 3,615,414; 4,175,960 and 4,082,551.

Two methods of development are used in electrophotography: discharged area development (DAD) and charged area development (CAD). The former system uses toner of the same polarity as the initial charge on the film. The latter system utilizes toner of polarity opposite to the polarity of the charge on the film. CAD has been more commonly used in optical copiers, while DAD is more desirable for digital printer and digital copier applications, since the exposure device has less on-time, resulting in longer exposure device life.

However, dielectric breakdown of the photoconductor is a serious problem in DAD systems. The phenomenon is manifested as black spots in the white background of the image. Black spots occur where it appears that the photoconductor is unable to sustain a charge, that is, the electric field across the photoconductor breaks down. Since discharged areas are developed in a DAD system, black spots in the white background of the image result. In the past, with systems of larger particle size toners and less efficient transfers, black spots have not been a significant problem. However, with new smaller toner size and improved transfer, the problem must be addressed.

Typical methods for alleviating black spots include incorporation of barrier or intermediate layers between the substrate electrode and the charge generation layer to prevent charge injection. For examples of this methodology, see U.S. Pat. Nos. 5,376,485; 5,320,922 and 5,071,723. One disadvantage of such techniques is that an extra layer must be incorporated into the film, introducing another step to the manufacturing process. A decrease in photosensitivity or stability over time and different environmental conditions is often observed.

SUMMARY OF THE INVENTION

The present invention provides a multiactive photoconductive element comprising, in the following order, (A) a conductive layer, (B) an aggregate charge generation layer in direct physical contact with the conductive layer; wherein the charge generation layer contains (i) a binder and, (ii) based on the total solid content of the charge generation layer, 4 to 10 weight percent of an adhesive polymer selected from the group consisting of:

(a) polyesters prepared from units derived from at least one aromatic dicarboxylic acid component and at least one diol component, at least one of said acid or diol components being a branched monomer selected from the group consisting of an isophthalic acid component or a branched-chain alkylene diol having the formula:

$$HO—CH_2—R—CH_2—OH \qquad \text{I}$$

in which R is a branched-chain alkylene group, and (b) polyester copolymers prepared from units derived from at least one aromatic dicarboxylic acid component and at least one of said acid or said diol components being a mixture of at least two different acids or two different diols, respectively, a copolyester is obtained, and at least one of said acid or one of said diol components being selected from the group consisting of a branched monomer as defined above or a cycloaliphatic diol; and (c) a charge transport layer comprising a binder according to formula II:

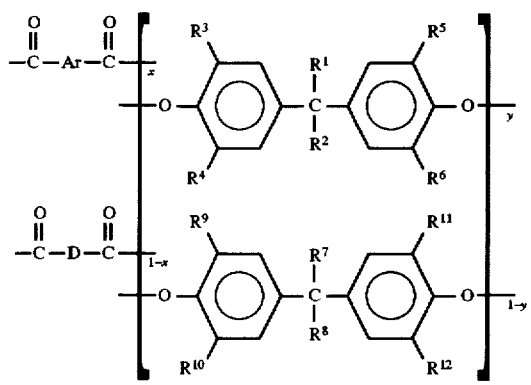

II wherein

Ar represents 1,4-phenylene, 1,3-phenylene, 5-t-butyl-1,3-phenylene and 1,1,3-trimethyl-3-phenylindanylidene.

D represents alkylene, linear or branched, or cycloalkyl, having from 4 to about 12 carbons;

$R^1$, $R^2$, $R^7$, and $R^8$ represent H, alkylene having 1 to 4 carbon atoms, cyclohexylidene, norbornylidene, phenylindanylidene, perfluoroalkyl having 1 to 4 carbon atoms, α,α-dihydrofluoroalkyl having 1 to 4 carbon atoms, and α,α,ω-hydrofluoroalkyl having 1 to 4 carbon atoms; and $R^3$, $R^4$, $R^5$, $R^6$, $R^9$, $R^{10}$, $R^{11}$, and $R^{12}$ represent, H, and alkyl having from 1 to about 6 carbons; x is from 0 to 0.8; and y is from 0 to 1.

In a DAD system this electrophotographic element is resistant to black spots. Compared to the prior art, some embodiments of the invention exhibit more stable residual voltage during continued electrical recycling. Such embodiments also maintain excellent film speed.

DETAILS OF THE INVENTION

Methods of making the multiactive electrophotographic elements of the invention are described below.

The charge generation layer is generally made up of a charge generation material dispersed in an electrically insulating polymeric binder and the adhesive polyester according to the invention. Optionally, various sensitizing materials such as spectral sensitizing dyes and chemical sensitizers may also be incorporated in the charge generation layer.

Aggregate charge generating materials are well known. Exemplary charge generation materials are disclosed in, for example, Light U.S. Pat. No. 3,615,414 issued Oct. 26, 1971 and Gramza et al U.S. Pat. No. 3,615,396 issued Oct. 26, 1971. Such aggregate materials comprise a continuous binder phase containing dispersed therein a particulate, co-crystalline complex of (i) a pyrylium-type dye salt such as a 2,4,6-substituted thiapyrylium dye salt and (ii) a polymer having an alkylidene diarylene group in a recurring unit thereof, e.g., a bisphenol A polycarbonate. Preferably, although not required, one or more charge transport materials are contained in solid solution with the continuous binder phase of the aggregate photoconductive composition.

The aromatic dicarboxylic acid component used to prepare the adhesive polyesters employed in the invention is isophthalic or terephthalic acid or derivatives thereof including the corresponding esters derived from said acids, for example, diethylisophthalate and dimethylterephthalate and their corresponding acid anhydrides and acid chlorides. A particularly useful dicarboxylic acid component used in the present invention may comprise a mixture of the foregoing dicarboxylic acid materials.

Typically, the branched-chain alkylene diol component represented by structural formula I, hereinabove, contains a branched-chain alkylene group (R in formula I above) having from 2 to about 15 carbon atoms, preferably from 3 to 7 carbon atoms. Examples of suitable branched-chain alkylene groups include isoalkylidene groups such as isopropylidene, and isobutylidene, branched-chain pentylene and branched-chain hexylene, though isopropylidene is preferred. The alkylene groups are attached to the diol to form symmetrical or unsymmetrical side chains. Neoalkylene groups are generally preferred, i.e. those having at least one carbon atom connected directly with four other carbon atoms, e.g. neopentylene (2,2-dimethyl-1,3-trimethylene). Examples of suitable diols containing both types of side chains include 2,2-diethyl-1,3-propanediol; 2,2-dimethyl-1,3-propanediol (neopentyl glycol); 2-methyl-2-ethyl-1,3-propanediol; 3,3-dimethyl-1,5-pentanediol and 3,3-diethyl-1,5-pentanediol.

Useful adhesive polyesters are described in U.S. Pat. No. 4,284,699. A non-limiting list of useful adhesive polymers include:

a) poly[ethylene-co-2,2-dimethyl-1,3-propylene terephthalate];

b) poly[ethylene-co-2,2-dimethyl-1,3-propylene terephthalate-co-isophthalate];

c) poly[ethylene-co-4,4'-isopropylidenebisphenoxyethylene terephthalate];

d) poly[2,2'-oxydiethylene-co-2,2-dimethyl-1,3-propylene terephthalate]; and

Particularly useful adhesive polyesters were prepared by techniques described in W. R. Sorensen and T. W. Campbell, "Preparative Methods of Polymer Chemistry," p.113 Interscience Publishing (1961) and are known to those familiar with the art.

Adhesive Polymer 1 (A1); poly[ethylene-co-2,2-dimethyl-1,3-propylene (55/45) terephthalate]

38.8 grams of dimethyl terephthalate, 13.1 grams of 2,2-dimethyl-1,3-propanediol, and 9.55 grams of ethylene glycol were combined in a 250 ml polymerization flask equipped with a stirrer, vigreux column, and nitrogen bubbler. The contents were heated to 200° C. and 3 drops of Titanium(IV) isopropoxide were added. The ester-interchange was done at 200° C. for 2 hours, then at 240° C. for an additional 2 hours. The flask was then fitted to a vacuum source and the polycondensation required to achieve the desired molecular weight was completed. The resulting polyester had an inherent viscosity (IV) in methylene chloride (DCM) of 0.49 dl/g, a glass transition temperature (Tg) via DSC of 65° C., and a weight average molecular weight (Mw) via. SEC of 26,000.

Adhesive Polymer 2 (A2); poly[ethylene-co-2,2-dimethyl-1,3-propylene (25/75) terephthalate]

Adhesive polymer (A2) was prepared in the same fashion as A1 except that the glycol mixture consisted of 4.34 grams of ethylene glycol and 21.84 grams of 2,2'-dimethyl-1,3-propanediol. The resulting polyester had an IV/DCM of 0.38 dl/g, a Tg of 62° C., and a Mw of 31,000.

Adhesive Polymer 3 (A3); poly[ethylene-co-2,2-dimethyl-1,3-propylene (55/45) terephthalate-co-isophthalate (75/25)]

Adhesive polymer A3 was prepared in the same fashion as A1 except that 9.7 grams of dimethyl terephthalate was replaced with dimethylisophthalate. The resulting polyester has an IV/DCM of 0.36 dl/g, a Tg of 56° C., and a Mw of 27,000.

Adhesive Polymer 4 (A4); poly[ethylene-co-4,4'-isopropylidenebisphenoxyethylene (50/50)terephthalate]

Adhesive polymer A4 was prepared in the same fashion as Al except that the 2,2-dimethyl-1,3-propanediol was replaced with 31.8 grams of 4,4'-isopropylidenebisphenol diethanol. The resulting polyester has an IV/DCM of 0.41 dl/g, a Tg of 76° C., and a Mw of 32,000.

Adhesive Polymer 5 (A5); poly[2,2'oxydiethylene-co-2,2'-dimethyl-1,3-propylene (35/65) terephthalate]

Adhesive polyester A5 was prepared in the same fashion as A1 except that the glycols consisted of a mixture of 10.39 grams of 2,2'-oxydiethanol and 18.93 grams of 2,2-dimethyl-1,3-propanediol. The resulting polyester had an IV/DCM of 0.35 dl/g, a Tg of 52° C., and a Mw of 44,000.

The charge transport layer contains, as the active charge transport material, one or more charge transport materials capable of accepting and transporting charge carriers generated in the charge generation layer. Useful charge transport materials can generally be divided into two classes. That is, most charge transport materials generally will preferentially accept and transport either positive charges, holes, or negative charges, electrons, generated in the charge generation layer. Useful materials are known from the patent publications cited under "BACKGROUND OF THE INVENTION". The charge transport layer of such "multi-active" compositions comprises an organic photoconductive charge transport material such as described in the aforementioned patent publications such as Berwick et al's U.S. Pat. No. 4,173,472. Charge transport materials include, for example, a p-type organic photoconductor such as the arylamine, polyarylalkane and pyrrole materials.

The binders for the charge transport layers provided by the present invention can be prepared using well-known solution polymerization techniques such as disclosed in W. Sorenson and T. Campbell, "Preparative Methods of Polymer Chemistry," page 137, Interscience (1968). Polymers which were evaluated in the standard charge transport layer (CTL) for the described multi-layer photoreceptor were all prepared by means of solution polymerization techniques. Schotten-Baumann conditions were employed to prepare the polyester binder.

Those skilled in the art should refer to S. R. Sandler and W. Karo, "Polymer Synthesis Volume 1", page 67, Academic Press, New York (1974).

A class of useful charge transport polymeric binders have the formula II:

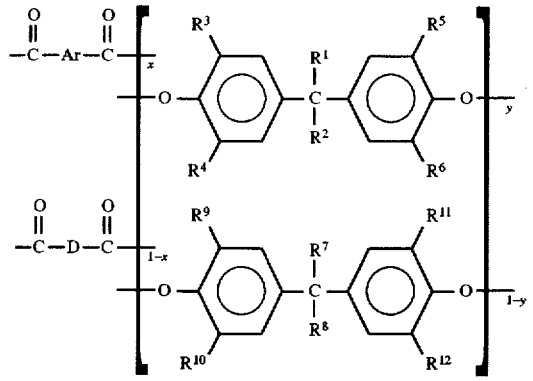

in which:

Ar represents 1,4-phenylene, 1,3-phenylene, 5-t-butyl-1,3-phenylene and 1,1,3-trimethyl-3-phenylindanylidene;

D represents alkylene, linear or branched, or cycloalkyl, having from 4 to about 12 carbons;

$R^1$, $R^2$, $R^7$, and $R^8$ represent H, alkylene having 1 to 4 carbon atoms, cyclohexylidene, norbornylidene, phenylindanylidene, perfluoroalkyl having 1 to 4 carbon atoms, α,α-dihydrofluoroalkyl having 1 to 4 carbon atoms, and α,α,ω-hydrofluoroalkyl having 1 to 4 carbon atoms; and $R^3$, $R^4$, $R^5$, $R^6$, $R^9$, $R^{10}$, $R^{11}$, and $R^{12}$ represent, H, halo and alkyl having from 1 to about 6 carbons; x is from 0 to 0.8; and y is from 0 to 1.

Specific polymeric binders falling within formula II, and their method of preparation is presented below.

Binder Polymer 1 (B1); poly[norbornylidenebisphenylene terephthalate-co-azelate (40/60)]

Twenty-eight grams norbornylidenebisphenol, 50.5 grams of triethylamine, and 550 ml of methylene chloride (DCM), were combined in a dry 3 liter, three neck round bottom flask. The flask was equipped with a stirrer, argon inlet, and dropping funnel. The contents of the flask were cooled and solution of 17.1 grams of terephthaloyl chloride, 28.4 grams of azelaoyl chloride, and 250 ml of DCM were added in a dropwise fashion while the contents were stirred at approximately 150 rpm. Upon addition of 90% of header the remainder was diluted with 150 ml of DCM, stirring was increased to 250 rpm, and the dropwise addition was continued until the desired solution viscosity was achieved. The reaction contents were then treated with 25 grams of concentrated sulfuric acid diluted with a liter of distilled water, followed by water washes until neutral. The product was isolated by precipitation into methanol to obtain a white, fibrous solid. The polymer was collected by filtration, followed by vacuum oven drying. The resulting product had an IV/DCM of 1.20 dl/g, a Tg of 148° C., and a Mw of 140,000.

Binder Polymer 2 (B2); poly[4,4'-isopropylidenebisphenylene-co-hexafluoroisopropylidene bisphenylene(75/25) terephthalate-co-azelate (65/35)]

Binder polymer B2 was prepared in the same fashion as polymer B1 except that the following reactants were employed: 35.9 grams of bisphenol A, 17.6 grams of hexafluoroisopropylidenebisphenol, 50.5 grams of triethylamine, and 550 ml of DCM were combined in a dry, 3 liter, three neck flask. The addition funnel contained 27.71 grams of terephthaloyl chloride, 15.54 grams of azelaoyl chloride, and 20 ml of DCM. The resulting product had an IV/DCM of 1.20 dl/g, a Tg of 149° C., and a Mw of 145,000.

Binder Polymer 3 (B3); poly[4,4'-isopropylidenebisphenylene-co-hexafluoroisopropylidene bisphenylene(70/30) terephthalate-co-azelate (65/35)]

Binder Polymer B3 was prepared in the same fashion as binder polymer B2 except that the mixture of bisphenols consisted of 33.5 grams of bisphenol A and 21.2 grams of hexafluoroisopropylidenebisphenol. The resulting polymer had an IV/DCM of 1.30, a Tg of 150° C., C, and a Mw of 154,000.

Binder Polymer 4 (B4); poly[4,4'-isopropylidenebisphenylene-co-hexafluoroisopropylidene bisphenylene (60/40) terephthalate-co-azelate (65/35)]

Binder polymer B4 was prepared in the same fashion as binder polymer B2 except that the mixture of bisphenols consisted of 28.73 grams of bisphenol A and 28.22 grams of hexafluoroisopropylidenebisphenol. The resulting polymer had an IV/DCM of 1.35, a Tg of 150° C., and a Mw of 150,000.

Binder Polymer 5 (B5); poly[4,4'-isopropylidenebisphenylene-co-hexafluoroisopropylidene bisphenylene (50/50) terephthalate-co-azelate (65/35)]

Binder polymer B5 was prepared in the same fashion as binder polymer B2 except that the mixture of bisphenols consisted of 23.94 grams of bisphenol A and 35.28 grams of hexafluoroisopropylidenebisphenol. The resulting polymer had an IV/DCM of 1.25, a Tg of 151° C., and a Mw of 160,000.

Binder Polymer 6 (B6); poly[4,4'-isopropylidenebisphenylene terephthalate-co-azelate-co-isophthalate (50/25/25)]

Binder polymer B6 was prepared in the same fashion as B1 except only 45.6 grams of bisphenol A was added to the three neck flask and the addition funnel contained a mixture of 21.32 grams of terephthaloyl chloride, 10.66 grams of isophthaloyl chloride, 11.82 grams of azelaoyl chloride, and 200 ml of DCM. The resulting polymer had an IV/DCM of 1.25 dl/g, a Tg of 150° C., and a MW of 145,000.

Additional binder polymers for the charge transport layer are presented below in Table 1:

TABLE 1

| | |
|---|---|
| 1. | poly[4,4'-isopropylidenebisphenylene terephthalate-co-azelate (70/30)] |
| 2. | poly[4,4'-isopropylidenebisphenylene terephthalate-co-isophthalate-co-azelate (50/25/25)] |
| 3. | poly[4,4'-isopropylidenebisphenylene-co-4,4'-hexafluoroisopropylidenebisphenylene (75/25) terephthalate-co-azelate (65/35)] |
| 4. | poly[4,4'-isopropylidenebisphenylene-co-4,4'-hexafluroisopropylidenebisphenylene (50/50) terephthalate-co-azelate (65/35)] |

The thickness of the charge transport layer may vary. It is especially advantageous to use a charge transport layer which is thicker than that of the charge generation layer, with best results generally being obtained when the charge transport layer is from about 2 to about 200 times, and particularly 3 to 40 times, as thick as the charge transport layer. A useful thickness for the charge transport layer is within the range of from about 12 to about 40 μm dry thickness. Within this range thicknesses of 12 to 27 μm and 18 to 24 μm are particularly useful.

Charge generation layers and charge transport layers in elements of the invention can optionally contain other addenda such as leveling agents, surfactants, plasticizers, sensitizers, antioxidants, and release agents, as is well known in the art.

The multilayer photoconductive elements of the invention can be affixed, if desired, directly to an electrically conducting substrate. In some cases, it may be desirable to use one or more intermediate subbing layers between the conducting substrate to improve adhesion to the conducting substrate and/or to act as an electrical barrier layer between the multi-active element and the conducting substrate as described in Dessauer, U.S. Pat. No. 2,940,348.

Electrically conducting supports include, for example, paper (at a relative humidity above 20 percent); aluminum-paper laminates; metal foils such as aluminum foil, zinc foil, etc.; metal plates, such as aluminum, copper, zinc, brass and galvanized plates; vapor deposited metal layers such as silver, chromium, nickel, aluminum and the like coated on paper or conventional photographic film bases such as cellulose acetate, polystyrene, poly(ethylene terephthalate), etc. Such conducting materials as chromium, nickel, etc., can be vacuum deposited on transparent film supports in sufficiently thin layers to allow electrophotographic elements prepared therewith to be exposed from either side of such elements.

In preparing the electrophotographic elements of the invention, the components of the charge generation layer, or the components of the charge transport layer, including binder and any desired addenda, are dissolved or dispersed together in one or more organic solvents to form a coating composition which is then solvent coated over an appropriate underlayer, for example, an electrically conductive layer or support. The solvent is then allowed or caused to evaporate from the mixture to form the charge generation layer or charge transport layer.

Suitable organic solvents include aromatic hydrocarbons such as benzene, toluene, xylene and mesitylene; ketones such as acetone, α-butanone and 4-methyl-2-pentanone; halogenated hydrocarbons such as dichloromethane, 1,1,1-trichloroethane 1,1,2-trichloroethane, chloroform and ethylene dichloride; ethers including ethyl ether and cyclic ethers such as dioxane and tetrahydrofuran; other solvents such as acetonitrile and dimethylsulfoxide; and mixtures of such solvents. The amount of solvent used in forming the binder solution is typically in the range of from about 2 to about 100 parts of solvent per part of binder by weight, and preferably in the range of from about 10 to 50 parts of solvent per part of binder by weight.

In the coating compositions, the optimum ratios of charge generation material or of both charge generation material and charge transport material, to binder can vary widely, depending on the particular materials employed. In general, useful results are obtained when the total concentration of both charge generation material and charge transport material in a layer is within the range of from about 10 to about 90 weight percent, based on the dry weight of the layer. In a preferred embodiment of a multiple layer electrophotographic element of the invention, the coating composition contains from about 20 to about 60 weight percent of charge transport agent and from 10 to about 80 weight percent of charge generation material.

The initial image forming step in electrophotography is the creation of an electrostatic latent image on the surface of a photoconducting insulator. This can be accomplished by charging the element in the dark to a potential of several hundreds volts by either a corona or roller charging device, then exposing the photoreceptor to an imagewise pattern of radiation that corresponds to the image that is to be reproduced. Absorption of the image exposure creates free electron-hole pairs which then migrate through the charge transport layer under the influence of the electric field. In such a manner, the surface charge is dissipated in the exposed regions, thus creating an electrostatic charge pattern. Electrophotographic toner can then be deposited onto the charged regions (CAD) or the discharged regions (DAD). The resulting image can be transferred to a receiver and fused.

UTILITY EXAMPLES

The electrophotographic elements of the invention are clarified in the following examples.

Comparative Example

A multi-active electrophotographic element comprising a conductive support, an adhesive layer, a charge generation layer and a charge transport layer coated in that order, was prepared from the following compositions and conditions.

Coated on 5-mil nickelized poly(ethylene terephthalate) support at a dry coverage of 1.6125 g/m$^2$ was an adhesive layer solution containing 1.5 wt. % Polymer A1 in a 70/30 wt/wt mixture of dichloromethane and 1,1,2-trichloroethane.

A second layer, the charge generation layer was coated on the adhesive layer at a dry coverage of 6.558 g/m$^2$, the coating mixture comprising 49.5 wt % polycarbonate (Lexan 145™), 2.5 wt % polymer A1, 39.25 wt % 1,1-bis-[4-(di-4-tolylamino)phenyl]cyclohexane, 0.75 wt % diphenylbis-(4-diethylaminophenyl)methane, 6.4 wt % 4-(4-dimethylaminophenyl)-2,6-diphenylthiapyrylium hexafluorophosphate, 1.6 wt % 4-(4-dimethylaminophenyl)-2-(4-ethoxyphenyl)-6-phenylthiapyrylium fluoroborate, and 2.4 wt % of aggregate "seed" (a dried paste of the above charge generation layer mixture which had been previously prepared). The charge generation layer mixture was prepared at 9 wt % in an 80/20 (wt/wt) mixture of dichloromethane and 1,1,2-trichloroethane. A coating surfactant, DC510, was added at a concentration of 0.01 wt % of the total charge generation layer mixture. The mixture was filtered prior to coating with a 0.6 micron filter.

A third layer (charge transport layer) was coated onto the charge generation layer at a dry coverage of 22.58 g/m$^2$. The charge transport layer mixture comprised 60 wt % polymer B1, 19.75 wt % 1,1-bis-[4-(di-4-tolylamino)phenyl]cyclohexane, 19.5 wt % tri-(4-tolyl)amine, and 0.75 wt % diphenylbis-(4-diphenylbis(4-diethylaminophenyl)methane. The charge transport layer mixture was prepared at 10 wt % in a 70/30 (wt/wt) mixture of dichloromethane and methyl acetate. A coating surfactant, DC510, was added at a concentration of 0.024 wt % of the total charge transport layer mixture. Teflon beads were added to the solution as a friction aid.

Example 1

A multi-active electrophotographic element comprising a conductive support, a charge generation layer and a charge transport layer coated in that order, was prepared from the following compositions and conditions.

Coated on 5-mil nickelized poly(ethylene terephthalate) support at a dry coverage of 6.558 g/m$^2$ was a charge generation layer, with the coating mixture comprising 49.5 wt % polycarbonate (Lexan 145™), 9.8 wt % polymer A1, 39.25 wt % 1,1-bis-[4-(di-4-tolylamino)phenyl] cyclohexane, 0.75 wt % diphenylbis-(4-diethylaminophenyl)methane, 6.4 wt % 4-(4-dimethylaminophenyl)-2,6-diphenylthiapyrylium hexafluorophosphate, 1.6 wt % 4-(4-dimethylaminophenyl)-2-(4-ethoxyphenyl)-6-phenylthiapyrylium fluoroborate, and 2.4 wt % of aggregate "seed" (a dried paste of the above charge generation layer mixture which had been previously prepared). The charge generation layer mixture was prepared at 9 wt % in an 80/20 (wt/wt) mixture of dichloromethane and 1,1,2-trichloroethane. A coating surfactant, DC510, was added at a concentration of 0.01 wt % of the total charge generation layer mixture. The mixture was filtered prior to coating with a 0.6 micron filter.

A second layer (charge transport layer) was coated onto the charge generation layer at a dry coverage of 22.58 g/m$^2$. The charge transport layer mixture comprised 60 wt % polymer B1, 19.75 wt % 1,1-bis-[4-(di-4-tolylamino) phenyl]cyclohexane, 19.5 wt % tri-(4-tolylamine, and 0.75 wt % diphenylbis-(4-diethylaminophenyl)methane. The charge transport layer mixture was prepared at 10 wt % in a 70/30 (wt/wt) mixture of dichloromethane and methyl acetate. A coating surfactant, DC510, was added at a concentration of 0.024 wt % of the total charge transport layer mixture. Teflon beads were added to the solution as a friction aid.

Example 2

A multi-active electrophotographic element comprising a conductive support, a charge generation layer and a charge transport layer coated in that order, was prepared from the following compositions and conditions.

Coated on 5-mil nickelized poly(ethylene terephthalate) support at a dry coverage of 6.558 g/m$^2$ was a charge generation layer, with the coating mixture comprising 49.5 wt % polycarbonate (Lexan 145™), 9.8 wt % polymer A1, 39.25 wt % 1,1-bis-[4-(di-4-tolylamino)phenyl] cyclohexane, 0.75 wt % diphenylbis-(4-diethylaminophenyl)methane, 6.4 wt % 4-(4-dimethylaminophenyl)-2,6-diphenylthiapyrylium hexafluorophosphate, 1.6 wt % 4-(4-dimethylaminophenyl)-2-(4-ethoxyphenyl)-6-phenylthiapyrylium fluoroborate, and 2.4 wt % of aggregate "seed" (a dried paste of the above charge generation layer mixture which had been previously prepared). The charge generation layer mixture was prepared at 9 wt % in an 80/20 (wt/wt) mixture of dichloromethane and 1,1,2-trichloroethane. A coating surfactant, DC510, was added at a concentration of 0.01 wt % of the total charge generation layer mixture. The mixture was filtered prior to coating with a 0.6 micron filter.

A second layer (charge transport layer) was coated onto the charge generation layer at a dry coverage of 22.575 g/m$^2$. The charge transport layer mixture comprised 60 wt % polymer B5, 19.75 wt % 1,1-bis-[4-(di-4-tolylamino) phenyl]cyclohexane, 19.5 wt % tri-(4-tolyl)amine, and 0.75 wt % diphenylbis-(4-diethylaminophenyl)methane. The charge transport layer mixture was prepared at 10 wt % in a 70/30 (wt/wt) mixture of dichloromethane and methyl acetate. A coating surfactant, DC510, was added at a concentration of 0.024 wt % of the total charge transport layer mixture. Teflon beads were added to the solution as a friction aid.

Methodology for Evaluating Electrophotographic Elements for Black Spots

The methodology of the test by which electrophotographic elements were evaluated for black spots is described below. All electrophotographic elements described in these examples were evaluated by this method.

In a DAD system, black spot formation is dependent on film potential and the toning offset, which is the difference between the film potential and the toning station potential. In electrophotographic processes these set points vary, so it is necessary to understand the capability of the film under different conditions. As a result, each film variation is evaluated at three film potentials and at two toning offset voltages at each film potential. At each of the six test conditions, images are made and those images are evaluated by a number of judges in a subjective method. The subjective evaluation involves rating the images and putting them in one of five categories ranging from Category 1 where almost no black spots are seen under 7x magnification to Category 5 where very visible and obvious black spots are seen with the naked eye. Categories 1 through 3 are considered to have acceptable image quality while images in categories 4 and 5 have unacceptable image quality. The ratings for all judges are combined for a specific element.

Table 2 below shows the improved black spot performance of the elements of Examples 1 and 2 when compared to the comparative example.

TABLE 2

| Category | Comparative Example % of images in category | Example 1 % of images in category | Example 2 % of images in category |
|---|---|---|---|
| 1 (good image quality) | 4 | 21 | 21 |
| 2 | 29 | 21 | 50 |
| 3 acceptable IQ | 34 | 50 | 25 |
| 4 unacceptable IQ | 33 | 8 | 4 |
| 5 (very bad IQ) | 0 | 0 | 0 |

Table 2 shows that the electrophotographic elements of Examples 1 and 2 exhibit much fewer black spots in the white background of the images.

Evaluation of Regeneration Stability

It is essential for an electrophotographic element which is cycled many times in the electrophotographic process to maintain stable residual voltages close to zero during use. The electrophotographic element of Example 2 of the invention with respect to this property is distinctly better than the Comparative Example as seen in Table 3 below.

TABLE 3

| Cycle number | Residual Voltage of Comparative Example | Residual Voltage of Example 2 |
|---|---|---|
| 500 | −50V | −21V |
| 1,000 | −57V | −24V |
| 2,000 | −66V | −27V |
| 3,000 | −72V | −31V |

It may be seen from Table 3 that the behavior of the film of Example 2 of the invention is distinctly different from that of the Comparative Example. The residual voltage of the Comparative Example is −50 V after 500 cycles and it drifts farther from zero, to −72 V, after 3,000 cycles (delta V=22V). The residual voltage of Example 2 is only −21V after 500 cycles, and this value changes to only −31 V after 3,000 cycles (delta V=10V). Thus, the electrical cycling behavior of Example 2 is more desirable on two counts: the residual voltages are closer to zero than those for the Comparative Example and they are also more stable (smaller delta V).

The invention has been described in detail with particular reference to preferred embodiments thereof, but it will be understood that variations and modifications can be effected within the spirit and scope of the invention.

We claim:

1. A multiactive photoconductive element comprising, in the following order, (A) a conductive layer, (B) an aggregate charge generation layer in direct physcial contact with the conductive layer; wherein the charge generation layer contains (i) a binder and, (ii) based on the total solid content of the charge generation layer, 4 to 10 weight percent of an adhesive polymer selected from the group consisting of:

(a) polyesters prepared from units derived from at least one aromatic dicarboxylic acid component and at least one diol component, at least one of said acid or diol components being a branched monomer selected from the group consisting of an isophthalic acid component or a branched-chain alkylene diol having the formula:

$$HO—CH_2—R—CH_2—OH \quad \text{I}$$

in which R is a branched-chain alkylene group, and (b) polyester copolymers prepared from units derived from at least one aromatic dicarboxylic acid component and at least one of said acid or said diol components being a mixture of at least two different acids or two different diols, respectively, a copolyester is obtained, and at least one of said acid or one of said diol components being selected from the group consisting of a branched monomer as defined above or a cycloaliphatic diol; and (c) a charge transport layer comprising a binder according to formula II:

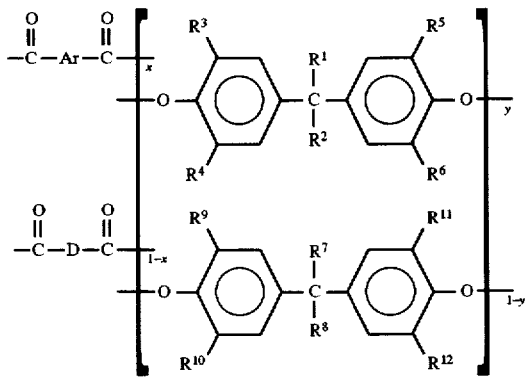

II wherein

Ar represents 1,4-phenylene, 1,3-phenylene, 5-t-butyl-1,3-phenylene and 1,1,3-trimethyl-3-phenylindanylidene.

D represents alkylene, linear or branched, or cycloalkyl, having from 4 to about 12 carbons;

$R^1$, $R^2$, $R^7$, and $R^8$ represent H, alkylene having 1 to 4 carbon atoms, cyclohexylidene, norbornylidene, phenylindanylidene, perfluoroalkyl having 1 to 4 carbon atoms, α,α-dihydrofluoroalkyl having 1 to 4 carbon atoms, and α,α,ω-hydrofluoroalkyl having 1 to 4 carbon atoms; and $R^3$, $R^4$, $R^5$, $R^6$, $R^9$, $R^{10}$, $R^{11}$, and $R^{12}$ represent, H, and alkyl having from 1 to about 6 carbons; x is from 0 to 0.8; and y is from 0 to 1.

2. The element of claim 1 wherein the aggregate charge generating layer comprises an adhesive polymer selected from the list consisting of:

a) poly[ethylene-co-2,2-dimethyl-1,3-propylene terephthalate];

b) poly[ethylene-co-2,2-dimethyl-1,3-propylene terephthalate-co-isophthalate];

c) poly[ethylene-co-4,4'-isopropylidenebisphenoxyethylene terephthalate];

d) poly[2,2'-oxydiethylene-co-2,2-dimethyl-1,3-propylene terephthalate].

3. The element according to claim 1 wherein the aggregate layer comprises an adhesive polymer selected from the list consisting of:

a) poly[ethylene-co-2,2-dimethyl-1,3-propylene (55/45) terephthalate];

b) poly[ethylene-co-2,2-dimethyl-1,3-propylene (25/75) terephthalate];

c) poly[ethylene-co-2,2-dimethyl-1,3-propylene (55/45) terephthalate-co-isophthalate (75/25)];

d) poly[ethylene-co-4,4-isopropylidenebisphenoxyethylene (50/50) terephthalate];

e) poly[2,2'-oxydiethylene-co-2,2-dimethyl-1,3-propylene (35/65) terephthalate].

4. The element according to claim 1 wherein the charge transport layer comprises a binder selected from the group consisting of:

a) poly[4,4'-iospropylidenebisphenylene terephthalate-co-azelate];

b) poly[4,4'-isopropylidenebisphenylene terephthalate-co-isophthalate-co-azelate];

c) poly[4,4'-isopropylidenebisphenylene-co-4,4'-hexafluoroisopropylidenebisphenylene terephthalate-co-azelate];

d) poly[norbornylidenebisphenylene terephthalate-co-azelate]; and e) poly[4,4'-isopropylidenebisphenylene-co-hexafluoroisopropylidenebisphenylene terephthalate-co-azelate].

5. The element of claim 4 wherein the binder in the charge transport layer is selected from the group consisting of:

a) poly[norbornylidenebisphenylene terephthalate-co-azelate (40/60)];

b) poly[4,4'-isopropylidenebisphenylene-co-hexafluoroisopropylidenebisphenylene (75/25) terephthalate-co-azelate (65/35)];

c) poly[4,4'-isopropylidenebisphenylene-co-hexafluoroisopropylidenebisphenylene (70/30) terephthalate-co-azelate (65/35)];

d) poly[4,4'-isopropylidenebisphenylene-co-hexafluoroisopropylidenebisphenylene (60/40) terephthalate-co-azelate (65/35)];

e) poly[4,4'-isopropylidenebisphenylene-co-hexafluoroisopropylidenebisphenylene (50/50) terephthalate-co-azelate (65/35)]; and f) poly[4,4'-isopropylidenebisphenylene terephthalate-co-azelate-co-isophthalate (50/25/25)].

6. The element of claim 1 wherein the adhesive polyester in the charge generation layer is from 4.7 wt. % to 10 wt. % of the total solids in the layer.

7. The element of claim 6 wherein the adhesive polyester is 4 to 6 weight percent of the total solids in the charge generation layer.

8. The element of claim 1 wherein the charge transport layer has a thickness of 12 to 40 μm.

9. The element of claim 8 wherein the charge transport layer has a thickness of 18 to 27 μm.

10. The element of claim 1 wherein: the charge generation layer comprises (i) a co-crystalline complex of 4-(4-dimethylaminophenyl)-2,6-diphenylthiapyrylium hexafluorophosphate, 4-(4-dimethylaminophenyl)-2-(4-ethoxyphenyl)-6-phenylthiapyrylium fluoroborate and bisphenol A phosgene polycarbonate and (ii) 1,1-bis[4-(di-4-tolylamino)phenyl]cyclohexane, (iii) diphenylbis-(4-diethylaminophenyl)methane and (iv) poly[ethylene-co-2,2-dimethyl-1,3-propylene terephthalate] adhesive polymer and the charge transport layer comprises (a) a polymer selected from the group consisting of (i) poly [norbornylidenebisphenylene terephthalate-co-azelate(40/60)] and (ii) poly[4,4'-isopropylidenebisphenylene-co-hexafluoroisopropylidenebisphenylene (50/50) terephthalate-co-azelate (65/35)]; and (b) the charge transport materials 1,1-bis-[4-(di-4-tolylamino)phenyl] cyclohexane, tri-(4-tolyl)amine, and diphenylbis-(4-diethylamino-phenyl)methane.

11. The element of claim 10 wherein the polymer in the charge transport layer is poly[4,4'-isopropylidenebisphenylene-co-hexafluoroisopropylidenebisphenylene (50/50) terephthalate-co-azelate (65/35)].

* * * * *